US007604146B2

(12) United States Patent
Maissami

(10) Patent No.: US 7,604,146 B2
(45) Date of Patent: Oct. 20, 2009

(54) APPARATUS AND METHOD FOR DISPENSING ELONGATED ITEMS

(75) Inventor: Fari Maissami, Hinsdale, IL (US)

(73) Assignee: Denbur, Inc., Westmont, IL (US)

( * ) Notice: Subject to any disclaimer, the term of this patent is extended or adjusted under 35 U.S.C. 154(b) by 0 days.

(21) Appl. No.: 11/703,852

(22) Filed: Feb. 8, 2007

(65) Prior Publication Data

US 2007/0181588 A1 Aug. 9, 2007

Related U.S. Application Data

(60) Provisional application No. 60/771,337, filed on Feb. 8, 2006.

(51) Int. Cl.
*G07F 11/00* (2006.01)

(52) U.S. Cl. ..... 221/288; 221/312 C; 221/206; 220/221

(58) Field of Classification Search ..... 221/288, 221/312, 215, 203, 266, 206, 196; 220/221, 220/222

See application file for complete search history.

(56) References Cited

U.S. PATENT DOCUMENTS

| | | | | | |
|---|---|---|---|---|---|
| 901,548 | A * | 10/1908 | Nelson | 221/312 R |
| 1,602,999 | A * | 10/1926 | Brown | 221/312 R |
| 1,696,080 | A * | 12/1928 | Draggie | 221/284 |
| 1,982,112 | A * | 11/1934 | Lang | 206/380 |
| 2,219,422 | A * | 10/1940 | Jordan | 221/288 |
| 2,448,099 | A * | 8/1948 | Kassovic | 221/312 R |
| 2,515,378 | A * | 7/1950 | Nicolle | 221/64 |
| 3,080,998 | A * | 3/1963 | La Cas | 221/232 |
| 3,189,221 | A * | 6/1965 | LaChance | 221/192 |
| 3,289,885 | A * | 12/1966 | Villaveces | 221/288 |
| 3,414,162 | A * | 12/1968 | Leonforte | 221/266 |
| 3,815,734 | A * | 6/1974 | Kruckel | 206/443 |
| 3,991,908 | A * | 11/1976 | Thomas et al. | 221/154 |
| 4,163,496 | A * | 8/1979 | Dogliotti | 206/538 |
| 4,271,979 | A * | 6/1981 | Manz | 221/288 |
| 4,308,974 | A * | 1/1982 | Jones | 221/196 |
| 4,354,619 | A * | 10/1982 | Wippermann et al. | 221/263 |
| 4,648,529 | A * | 3/1987 | Blakemore et al. | 221/1 |
| 4,653,668 | A * | 3/1987 | Gibilisco et al. | 221/298 |
| 5,086,941 | A * | 2/1992 | English et al. | 220/345.2 |
| 5,232,130 | A * | 8/1993 | Woodard | 222/464.1 |
| 5,482,172 | A * | 1/1996 | Braddock | 222/478 |
| 5,897,025 | A * | 4/1999 | Flewitt et al. | 221/257 |
| 5,938,062 | A * | 8/1999 | Paramski | 220/254.9 |
| 5,947,329 | A * | 9/1999 | Bailey | 221/288 |
| 6,068,126 | A * | 5/2000 | DeJonge | 206/538 |
| 6,112,942 | A * | 9/2000 | Deacon | 221/266 |
| 6,247,595 | B1 * | 6/2001 | Omata et al. | 206/534.2 |
| 6,302,295 | B1 * | 10/2001 | Weisman | 221/188 |
| 7,066,349 | B2 * | 6/2006 | Cohen | 221/92 |

(Continued)

*Primary Examiner*—J. Allen Shriver, II
*Assistant Examiner*—Michael McDuffie
(74) *Attorney, Agent, or Firm*—Pauley Petersen & Erickson

(57) ABSTRACT

This invention generally relates to an apparatus and a method for singularly dispensing elongated items. Specifically, this invention may include an elongated body forming a channel and a baffle to separate at least one elongated item from a plurality of elongated items. The width of the channel is preferably less than twice a thickness of the elongated item so that an elongated item may align under an aperture. The elongated item may then pass one at a time through the aperture to minimize potential cross-contamination. This apparatus and method may be particularly useful for dispensing dental applicators or other tooth cleaning devices.

19 Claims, 6 Drawing Sheets

U.S. PATENT DOCUMENTS 7,073,685 B1 * 7/2006 Giraud et al. ..... 221/64
7,100,797 B2 * 9/2006 Kahn et al. ..... 221/288
7,124,909 B1 * 10/2006 Armato ..... 220/836
2003/0234195 A1 * 12/2003 Earl et al. ..... 206/338
2005/0000979 A1 * 1/2005 Loshkajian ..... 221/282
2005/0067476 A1 * 3/2005 Hengami ..... 229/129.1
2005/0205598 A1 * 9/2005 Gelardi ..... 221/263

* cited by examiner

APPARATUS AND METHOD FOR DISPENSING ELONGATED ITEMS

CROSS REFERENCE TO RELATED APPLICATION

This application claims the benefit of U.S. Provisional Application No. 60/771,337 filed on 08 Feb. 2006.

BACKGROUND OF THE INVENTION

1. Field of the Invention

This invention generally relates to an apparatus and a method for singularly dispensing elongated items. Specifically, this invention may include an elongated body forming a channel and a baffle to separate at least one elongated item from a plurality of elongated items. The width of the channel is preferably less than twice a thickness of the elongated item so that an elongated item may align under an aperture. The elongated item may then pass one at a time through the aperture to minimize potential cross-contamination. This apparatus and method may be particularly useful for dispensing dental applicators or other tooth cleaning devices.

2. Description of Related Art

Applicators may be widely used in dentistry to apply dental compositions or materials to a tooth surface. Applicators also may be used to clean the excess materials surrounding a tooth preparation. Such applicators are typically disposable and remain in a hygienic environment or containers in order to prevent cross-contamination of materials or patients. Typically, applicators may be housed in tubes or dispensers in order to allow ready and easy access to the applicators while maintaining the applicators in a hygienic environment. Dispensers may be cylindrical in form with a cap and with an opening either in the center of the cap or on the side of the cap to dispense the applicators from the opening.

One existing vertical dispenser design includes an outer diameter of the central opening of the cap that is fractionally larger than the outer diameter of the applicators. The operator may shake the dispenser with a side-to-side motion in order to dispense an applicator and the applicator may "find" the opening to dispense the applicator one at a time. This dispenser design may control dispensing one applicator at a time until there are only a few applicators left in the dispenser. However, the remaining applicators are increasingly difficult to remove from the opening and the operator may resort to removing the cap from the dispenser to slide the applicators out of the dispenser from the open top. In this situation, there may be little control over how many applicators may be dispensed and the operator may cross-contaminate some or all of the remaining applicators.

Other types of hand-held dispensers include a triangular V-Shaped, or U-Shaped opening on the side of the cap. In these dispensers, the triangular V-Shaped or U-Shaped openings on the cap typically may be much larger than the outer diameter of the applicators. These types of dispensers may include either a horizontal or a vertical position in order to dispense the applicators whereby the applicators may pile on top of each other. With a large triangular V-Shape, or U-Shaped opening, many applicators may exit the opening when shaken or moved in a reciprocating manner to dispense an applicator. The operator may receive multiple applicators when trying to dispense one applicator which again may lead to cross-contamination as other applicators rush back into the dispenser and thereby contaminate other applicatiors and the dispenser itself.

In view of the above, there is a need and demand for an improved hand-held dispenser that minimizes the risk of cross-contamination. In particular, there is a need and demand for a hand-held dispenser that provides a precise and controllable dispensing of one elongated item at a time without the operator touching more than one elongated item at a time when dispensing the elongated item.

SUMMARY OF THE INVENTION

A general object of this invention is to provide an improved hand-held dispenser. A more specific objective of this invention is to overcome one or more of the problems described above.

The general object of this invention is attained at least in part through an apparatus for singularly dispensing an elongated item including an elongated body with a top, an inner wall, and an interior volume. A baffle is preferably disposed on the inner wall within the interior volume and oriented relative to the inner wall whereby the baffle forms a channel to receive at least one elongated item and may include a width less than twice a thickness of an elongated item. An aperture is preferably included in the top above the channel and adapted to permit passage of a single item.

Other objects of this invention may further be attained at least in part by an apparatus for singularly dispensing an item including an elongated, semi-cylindrical, hand-held, plastic body with a top, an inner wall, a flat side portion, and an interior volume. A baffle is preferably disposed on the inner wall within the interior volume and oriented relative to the inner wall and the baffle forms a channel to receive at least one elongated item wherein the channel may include a width less than twice a thickness of an elongated item. A removable cap may be disposed on the top and hingedly connect the body. An aperture may be positioned in the cap above the channel and adapted to permit passage of a single item. A removable cover may be over the aperture and hingedly connect the cap.

Additional objects of this invention may be attained by a method for singularly dispensing an item from a plurality of elongated items including providing an apparatus with a plurality of elongated items therein. The steps preferably include rotating the apparatus and urging at least one elongated item around the baffle, along the inner wall and into the channel so that at least one elongated item may be aligned within the channel and separated from the remaining plurality of elongated items. The steps may further include reciprocating the apparatus to pass one elongated item through the aperture.

Other objects and advantages will be apparent to those skilled in the art from the following detailed description taken in conjunction with the appended claims and the drawings.

BRIEF DESCRIPTION OF THE DRAWINGS

The above and other objects of this invention may be better understood when the specification is read in view of the drawings, wherein.

DETAILED DESCRIPTION

This invention relates to an apparatus 10 for singularly dispensing an elongated item 12. Singularly, as used herein, generally refers to one elongated item 12 at a time and not allowing more than one other elongated item or a part of one other elongated item to be dispensed while the first elongated item 12 is being removed. Dispensing typically refers to serving, presenting, distributing, handing, removing and/or giving elongated item 12.

Figure 6:
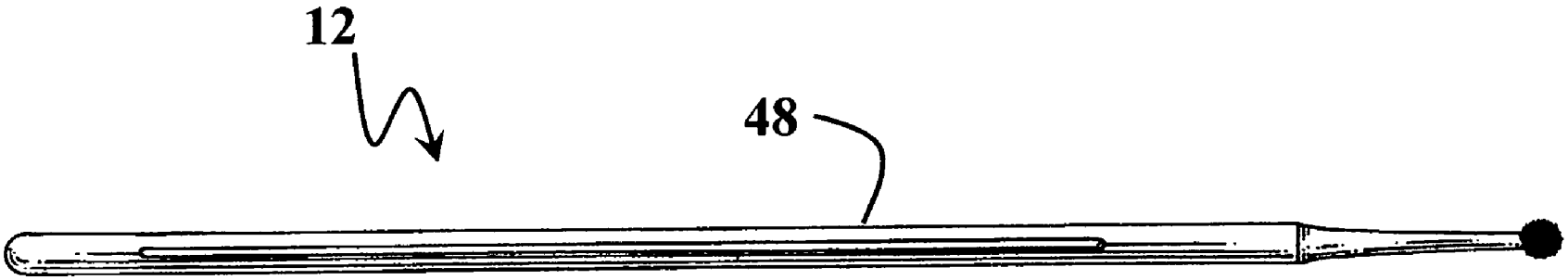
FIG. 6 is a perspective view of an elongated item, according to one preferred embodiment of this invention.

Elongated items 12 may be used for various applications and may include different objects such as toothpicks, paintbrushes, writing instruments, mechanical fasteners, and/or any other suitable device generally with a length several times greater than a width. Apparatus 20 may be particularly useful for dispensing dental applicators 48, such as shown in FIG. 6. Elongated item 12 may include a somewhat irregular shape and/or include features such as bristles, lips, ridges, or other extensions that may cause binding or difficulty while dispensing. Elongated item 12 may be individually wrapped or sealed such as, for example, a straw but typically is unwrapped. Generally, elongated item 12 may be hand-held or portable but may include larger and/or smaller sized objects.

Figure 1:
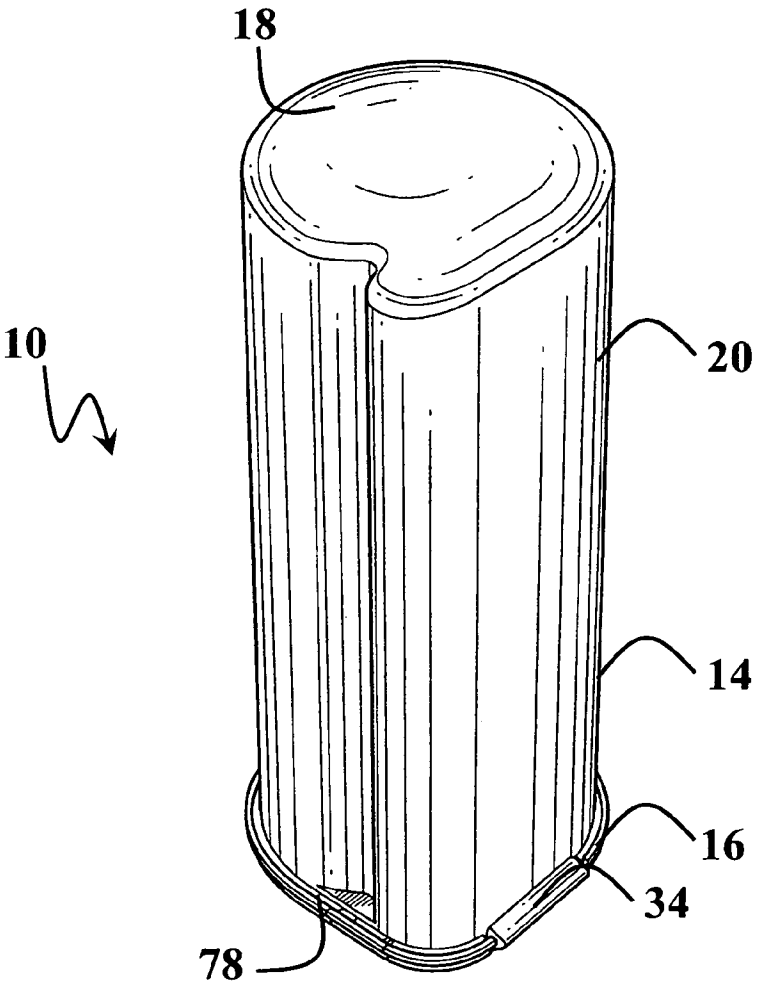
FIG. 1 is a perspective view of the apparatus according to one preferred embodiment of this invention.
Figure 2:
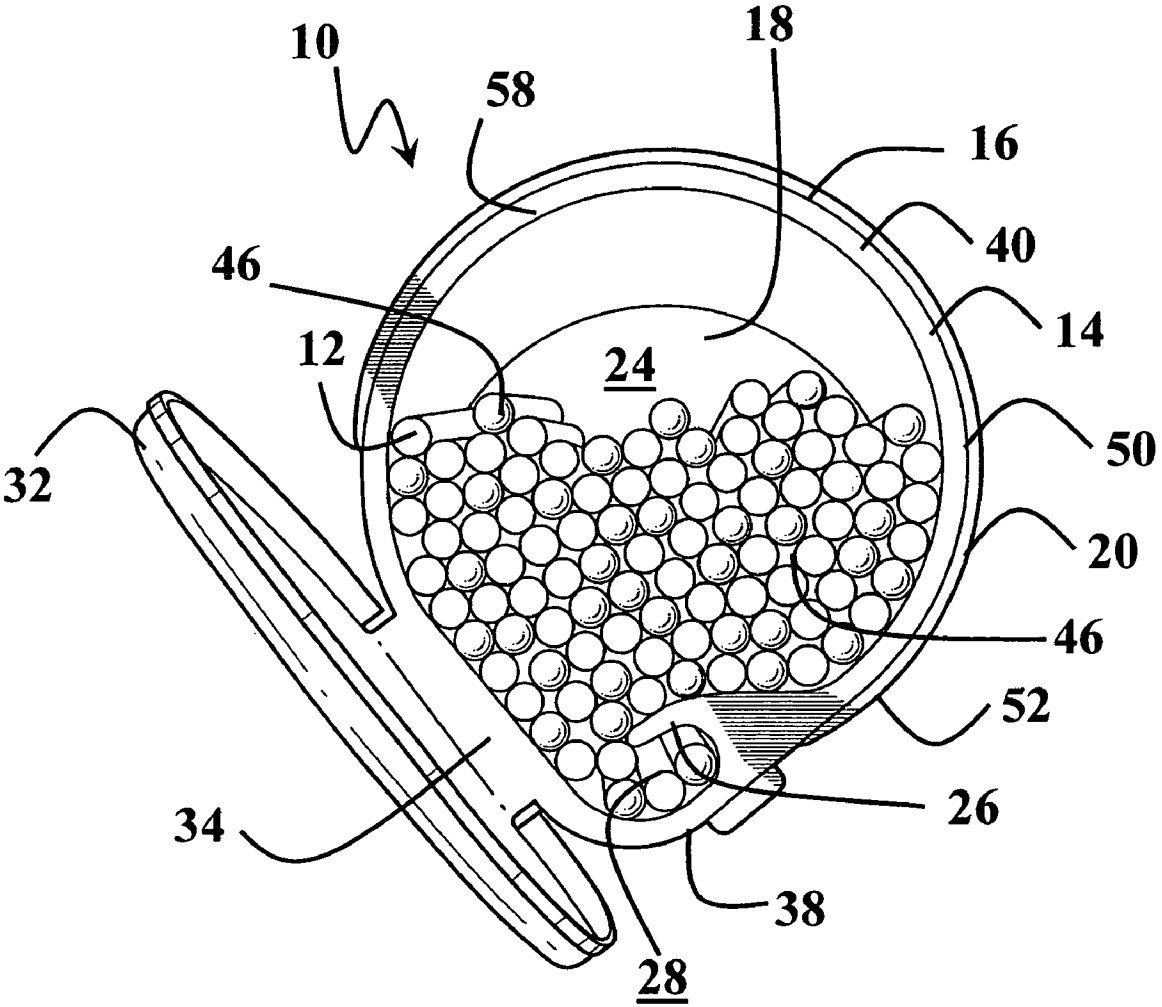
FIG. 2 is a side perspective interior view of the apparatus according to one preferred embodiment of this invention.

As shown in FIG. 1 and according to one preferred embodiment of this invention, apparatus 20 includes an elongated body 14 for holding, housing, containing, encasing, enclosing, surrounding and/or sheltering elongated item 12. As shown in FIG. 2 and according to a preferred embodiment of this invention, elongated body 14 may include top 16, bottom 18, at least one side 20 and interior volume 24. Side 20 may be, generally, several times longer than the width of top 16 and/or bottom 18. Elongated body 14 may be referred to as a barrel, a drum, a bucket, a cup, a vessel, a receptacle, a compartment, a case, a chamber and/or a reservoir.

Typically, elongated body 14 includes a semi-cylindrical cross section but may include other shapes such as, for example, circular, square, rectangle, oval and/or any other suitable shape to contain elongated item 12. According to one preferred embodiment of this invention, the elongated body 14 cross section may be asymmetric.

According to one preferred embodiment of this invention, the elongated body 14 cross section may be eccentric. Elongated Body 14 may include any suitable ergonomic shape to improve convenience and dispensing. According to one preferred embodiment of this invention, elongated body 14 cross section may be a generally cylindrical shape cut by at least one chord. This shape may also prevent the apparatus from rolling across or off of a horizontal surface.

The body 14 typically includes an interior contour 58 formed by the at least one side 20 and the interior volume 24. Generally, side 20 includes a length about equal to a length of elongated item 12. Generally, interior contour 58 may be smooth, rounded, radiused or chamfered but may include corners, angles and the like.

According to a preferred embodiment of this invention, interior contour 58, to facilitate the dispensing process, may include an interior arc of the inner wall including an angle of less than about 360 degrees, an interior section of the inner wall preferably connected to the interior arc, and baffle 26 that may run generally parallel along the interior section and preferably forms channel 28 therebetween the baffle 26 and inner wall. Interior section may be any shape adapted to assist the movement of elongated item 12 along channel 28 such as, for example, a substantially flat surface.

Figure 4:
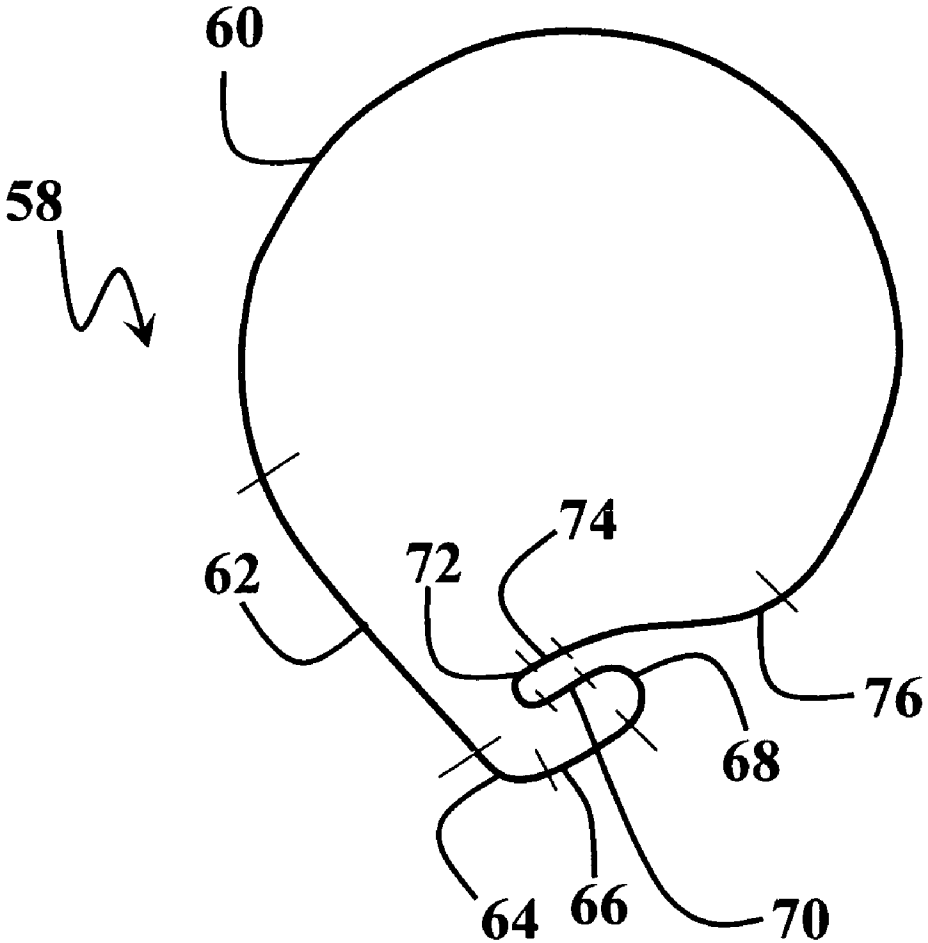
FIG. 4 is an outline of the interior contour of the apparatus according to one preferred embodiment of this invention.

According to a preferred embodiment of this invention and shown in FIG. 4, interior contour 58 to facilitate the dispensing process may include an irregular shape as formed by one or more of the following nine segments:

1. First interior arc 60 may include an angle of about 270 degrees and a first interior radius.
2. First interior generally linear portion 62 may include a length less than the first interior radius and preferably connects to first interior arc 60.
3. Second interior arc 64 may include an angle of about 90 degrees curving inward and a second interior radius less than the first interior radius. Second interior arc 64 preferably connects to first interior generally linear portion 62.
4. Second interior generally linear portion 66 may include a length less than the length of first interior generally linear portion 62 and preferably connects to second interior arc 64.
5. Third interior arc 68 may include an angle of about 180 degrees curving inward and a third interior radius such that twice the third interior radius may form a length less than twice the thickness of an elongated item 12. Third interior arc 68 preferably connects to the second interior generally linear portion 66.
6. Third interior generally linear portion 70 may include a length less than second interior generally linear portion 66 and preferably connects to third interior arc 68.
7. Fourth interior arc 72 may include an angle of about 180 degrees curving the opposite direction of third interior arc 68 and may include a radius less than the radius of third interior arc 68. Fourth interior arc 72 preferably connects to third interior generally linear portion 70.
8. Fourth interior generally linear portion 74 may include a length about equal to the length of third interior generally linear portion 70 and preferably connects to fourth interior arc 72.
9. Fifth interior generally linear portion 76 may angle outward from fourth interior generally linear portion 74 and preferably extends to first interior arc 60.

Elongated body 14 typically may include an exterior contour 78 formed by the at least one side 20. Generally, exterior contour 78 may be smooth, rounded, radiused or chamfered but may also include corners, angles and the like.

Figure 5:
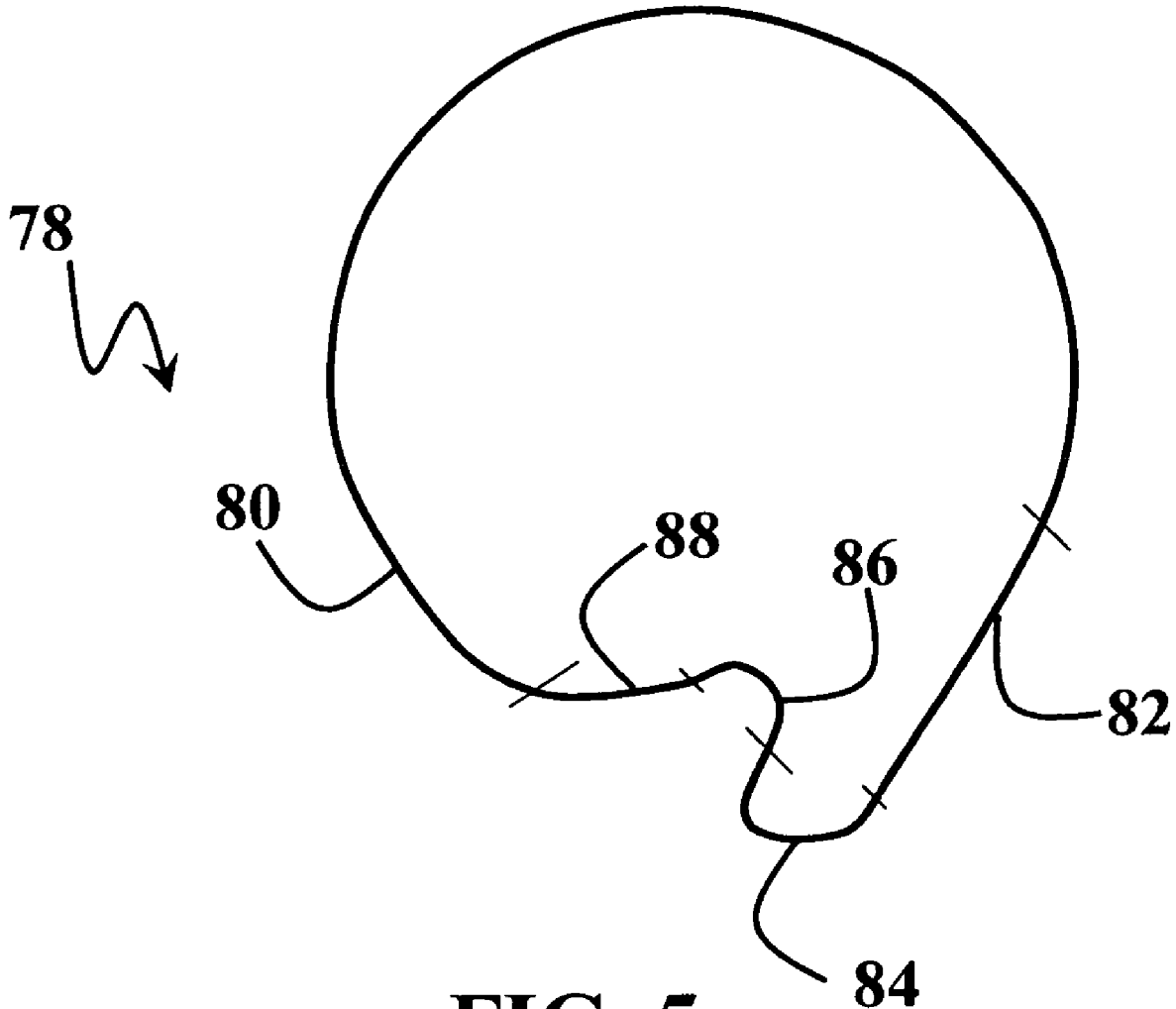
FIG. 5 is an outline of the exterior contour of the apparatus according to one preferred embodiment of this invention.

According to a preferred embodiment of this invention and shown in FIG. 5, exterior contour 78 may include an irregular shape, to correspond typically to interior contour 58, formed by one or more of the following five segments:

1. First exterior arc 80 may include an angle of about 270 degrees and a first exterior radius.
2. First exterior generally linear portion 82 may include a length less than the first exterior radius and preferably connects to first exterior arc 80.
3. Second exterior arc 84 may include an angle of about 180 degrees curving inward and a second exterior radius less than the first exterior radius. Second exterior arc 84 preferably connects to first exterior generally linear portion 82.
4. Third exterior arc 86 may include an angle of about 180 degrees curving opposite second exterior arc 84 and a third exterior radius less than the second exterior radius. Third exterior arc 86 preferably connects to second exterior arc 84.
5. Fourth exterior arc 88 may curve inward and preferably connects to first exterior arc 80.

According to a preferred embodiment of this invention and as shown in FIG. 5, elongated body 14 may include outside contour 78 forming a "comma" shape. Elongated body 14 may include a cam-like shape, arcuate shape and/or may include flat side part 38 and semi-cylindrical shape 40. Those skilled in the art and guided by the teaching herein will appreciate that many other suitable combinations of arcs and lines may be used to form interior contour 58 and exterior contour 78.

Elongated body 14 may be made of wood, metal, plastic and any other suitable material. Generally, but not necessarily, materials maybe chosen to include desirable cost, weight, strength, antibacterial, antimicrobial, antifungal, and/or sterilization properties. Suitable plastics or polymers may include polyethylene, polypropylene, polyacrylic, polyester, polycarbonate, urethane, engineered resin and/or any other suitable material. Typical manufacturing techniques may include extrusion, injection molding, blow molding, rotational molding, plastic welding, adhesive bonding, cutting, stamping, interference/tolerance fitting and/or any other suitable method for making apparatus 10. In one preferred embodiment of this invention, at least a part of apparatus 10 may be transparent. Apparatus 10 may be colored, opaque, translucent, painted, labeled and/or include any other desirable appearance. Apparatus 10 may be made from one single part or may be an assembly including a plurality of pieces or parts.

Baffle 26 may be disposed, positioned, located or fixed on the inner wall within the interior volume 24 and oriented relative to the inner wall. Baffle 26 may be referred to as a divider, partition, weir, dam, guide, shield and/or director. Typically, the direction of orientation of baffle 26 may run longitudinally from top 16 toward bottom 18. Baffle 26 may run a full length of side 20 or may be a part of a length of side 20. Baffle 26 may be flat and/or curved such as described as part of interior contour 58. More than one baffle may be used in apparatus 10. Baffle 26 typically may be integral or molded into elongated body 14 or it may be fabricated separately and removably or fixedly installed, mounted or disposed within or to the apparatus 10.

Baffle 26 may form channel 28 to receive at least one elongated item and channel 28 may include a width less than twice a thickness of an elongated item. Channel 28 may be referred to as a passageway, a duct, a conduit, a chute and/or a groove. The width of channel 28 may be less than twice a thickness of an elongated item 12 so that only one elongated item may pass within or through a position of channel 28 at a time.

According to a preferred embodiment of this invention, a column of elongated items 12 may form in channel 28. A column may be referred to as a line, a queue, a stack and/or a procession. Elongated items 12 in the column may be separated from the remaining plurality of items 46 within elongated body 14 of apparatus 10 and may be generally aligned laterally. Separated, divided and/or chosen elongated items 14 may include those where the weight of the reaming plurality of items 46 may be supported by baffle 26 whereby elongated items 12 in the column may be relatively unbound, impeded or unfettered by other elongated items 12, especially in an axial direction.

Figure 3:
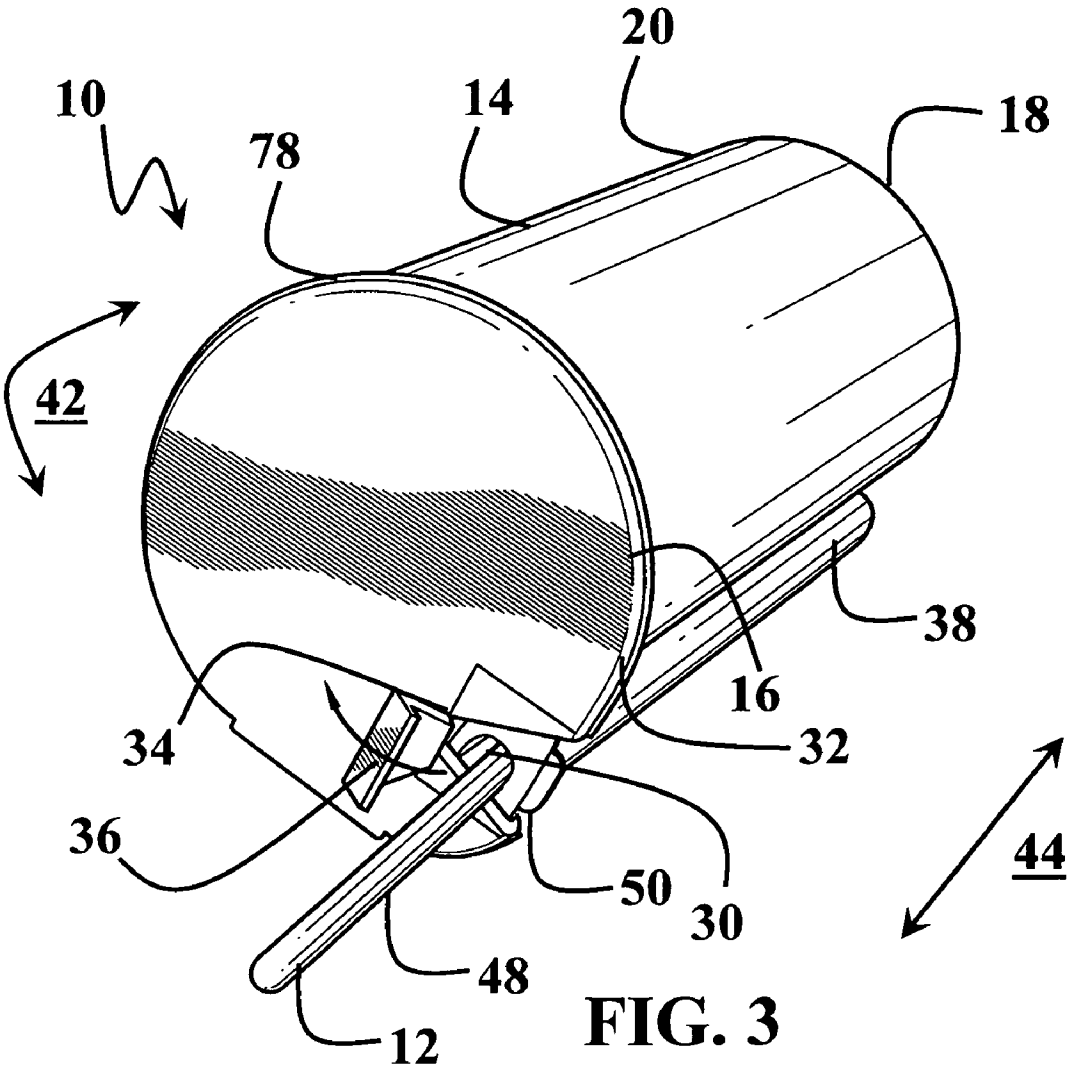
FIG. 3 is a perspective view of the apparatus dispensing an elongated item according to a preferred embodiment of this invention.

Apparatus 10 may include at least one aperture 30 in top 16 and/or bottom 18. Aperture 30 may be referred to as a slit, a hole, a slot and/or an opening. Desirably, aperture 30 may be in top 16 and above or substantially aligned with at least a portion of channel 28. According to a preferred embodiment of this invention, aperture 30 may be adapted to, designed for and/or made to permit or allow passage or conveyance of a single elongated item 12 at a time. Typically, restriction to a single elongated item 12 may be accomplished by aperture 30 with a diameter less than twice a thickness of elongated item 12. Elongated item 12 typically may pass through aperture 30 in a generally axial direction. Aperture 30 may be generally round, square, rectangular or any other suitable shape to permit passage of elongated item 12. According to a preferred embodiment of this invention and as shown in FIG. 3, aperture 30 may be round and located near a perimeter of top 16.

Top 16 and/or bottom 18 may further include cap 32. Cap 32 may be referred to as a lid, an enclosure, a door and/or a covering. Cap 32 may be useful for containing elongated items 12 within apparatus 10 when closed and may allow filling and/or refilling of apparatus 10 when opened or removed. Cap 32 may be attached, connected and/or tethered to body 14. According to a preferred embodiment of this invention and as shown in FIG. 2, cap 32 may be hingedly connected to body 14. Suitable hinges 34 may include pin and loop, piano, "living" hinges, such as may be typically made from plastic, and any other suitable pivoting joint or coupling joining mechanism.

Cap 32 may generally include a similar shape to an outline of elongated body 14 or may be differently shaped to facilitate dispensing. Cap 32 may desirably be removable or maybe secured or glued after loading initial contents of apparatus 10. Cap 32 may utilize lip 50 or ear and/or ridge 52, collar, ring, flange and/or groove to secure or contact body 14. Those skilled in the art and guided by the teachings herein will appreciate that various combinations of lip 50 and/or ridge 52 may be employed on either body 14 and/or cap 32 to achieve the desired results.

Aperture 30 may also include cover 36. Cover 36 typically at least may partially isolate aperture 30 and thereby the contents of apparatus 10 from the surroundings to maintain elongated items 12 in a contained and/or hygienic uncontaminated state. Cover 36 may initially be sealed or secured to ensure elongated items 12 remain in hygienic condition prior to initial dispensing. Desirably, cover 36 may be removable and/or reclosable. Cover 36 may be referred to as a lid or a top. Cover 36 may include hinges 34 and/or combinations of lip 50 and ridge 52 such as discussed above with respect to cap 32. In a preferred embodiment of this invention, cover may hingedly connect to cap 32.

This invention includes a method of singularly dispensing elongated item 12 from a plurality of elongated items 46 by apparatus 10. Generally, apparatus 10 may be positioned vertically or horizontally before being picked up or seized by or in the hand of the operator or the user. Once in the operator's hand and desirably in a substantially horizontal orientation, suitable rotation 42 or movement may be applied. Generally, this rotation may be about an elongated axis of apparatus 10. Desirably, this rotation with the assistance of gravity allows at least one elongated item 12 to follow interior contour 58 or inner wall of apparatus 10 and/or fall over or around baffle 26 to arrive in or at channel 28. Clockwise and/or counter clockwise rotation may assist or urge elongated item 12 into channel 28. Desirably rotation may be clockwise for a left oriented baffle 26 and channel 28, as shown in FIG. 2.

At least one elongated item 12 may align within channel 28 and may be separated from the remaining plurality of elongated items 46. Desirably, elongated item 12 in the channel may be separated from a weight of the plurality of elongated items 46 so that unfettered movement along the channel 28 and/or axially out of aperture 30 may result.

The method may further include suitably reciprocating 44 or shaking apparatus 10 to at least partially pass one elongated item 12 through the aperture 30. Typically, reciprocating may be in a horizontal or vertical orientation in or along an axial direction with respect to apparatus 10. Elongated item 12 may seek, hunt or find aperture 30 since it may be aligned in channel 28 below or adjacent to aperture 30. Suitable reciprocating motion may include a distance at least equal to about half a length of elongated item 12. Desirably a few relatively rapid motions convey elongated item 12 into and at least partially through aperture 30. The operator may then pull or remove elongated item 12 from aperture 30. According to a preferred embodiment of this invention, one elongated item 12 passes from aperture 30 at a time. Second elongated item 12 and/or successive elongated items 12 may be singularly dispensed as desired until depleting or emptying apparatus 10. Dispensing of the last or final elongated item 12 from apparatus 10 may readily occur with the baffle 26 and channel 28 arrangement.

An operator may remove cap 32 to dispense multiple elongated items 12 at once but does so at the undesirable risk of cross contamination or loss of a hygienic condition of the remaining elongated items 12. An operator may load an expected number of elongated items 12 into apparatus 10 as may be needed for a dental procedure and then dispose of the apparatus upon completion of the procedure. Alternatively, apparatus 10 may be reusable and/or refillable.

Additionally, the method may further include opening or removing cover 36 on the aperture 30 before reciprocating 44 to singularly pass at least one elongated item 12 and closing or shutting cover 36 after reciprocating 44. Desirably, the method may be completed with the use of only one hand from the operator. Upon dispensing, the operator may return apparatus 10 to the initial horizontal or vertical position.

While in the foregoing specification this invention has been described in relation to certain embodiments thereof, and many details have been set forth for purpose of illustration, it will be apparent to those skilled in the art that the invention is susceptible to additional embodiments and that certain of the details described herein may be varied considerably without departing from the basic principles of the invention.

What is claimed is:

1. An apparatus for singularly dispensing an elongated item comprising:

an elongated body having a top, an inner wall having a flat side with a length approximately equal to a length of the elongated item, and an interior volumes, wherein the elongated body has an inside contour formed by:

an interior arc of the inner wall having an angle of less than about 360 degrees;

an interior section of the inner wall connecting to the interior arc;

a baffle disposed on the inner wall within the interior volume and oriented generally parallel relative to the inner wall;

the baffle forming a channel along the inner wall to receive at least one elongated item, the channel having a width less than twice a thickness of the elongated item; and an aperture in the top above the channel and adapted to permit passage of a single item.

2. The apparatus of claim 1 wherein the elongated body has an asymmetric cross section.

3. The apparatus of claim 1 wherein the elongated body has an eccentric cross section.

4. The apparatus of claim 1 wherein the elongated body has a generally cylindrical shape cut by a chord.

5. The apparatus of claim 1 wherein the elongated body has a generally smooth inside contour formed by:

a first interior arc having an angle of about 270 degrees and a first interior radius;

a first interior generally linear portion with a length less than the first interior radius and connecting to the first interior arc;

a second interior arc having an angle of about 90 degrees curving inward and a second interior radius less than the first interior radius, the second interior arc connecting to the first interior generally linear portion;

a second interior generally linear portion with a length less than the length of the first interior generally linear portion and connecting to the second interior arc;

a third interior arc having an angle of about 180 degrees curving inward and a third interior radius such that twice the third interior radius has a length less than twice the thickness of an elongated item, the third interior arc connecting to the second interior generally linear portion;

a third interior generally linear portion with a length less than the second interior generally linear portion and connecting to the third interior arc;

a fourth interior arc having an angle of about 180 degrees curving opposite the third interior arc and a radius less than the radius of the third interior arc, the fourth interior arc connecting to the third interior generally linear portion;

a fourth interior generally linear portion having a length about equal to the length of the third interior generally linear portion and connecting to the fourth interior arc;

a fifth interior generally linear portion angling outward from the fourth interior generally linear portion and connecting to the first interior arc.

6. An apparatus for singularly dispensing an elongated item comprising:

an elongated, semi-cylindrical, hand-held, plastic body having a top, an inner wall, a flat side portion having a length approximately equal to a length of the elongated item, and an interior volume;

a baffle disposed on the inner wall within the interior volume and oriented relative to the inner wall;

the baffle forming a channel to receive at least one elongated item, the channel having a width less than twice a thickness of the elongated item;

a removable cap disposed on the top of and hingedly connecting to the body;

an aperture in the cap above the channel and adapted to permit passage of a single item: and a removable cover over the aperture and hingedly connecting to the cap.

7. The apparatus of claim 1 wherein the elongated body has an smooth outside contour formed by:

a first exterior arc having an angle of about 270 degrees and a first exterior radius:

a first exterior generally linear portion with a length less than the first exterior radius and connecting to the first exterior arc;

a second exterior arc having an angle of about 180 degrees curving inward and a second exterior radius less than the first exterior radius, the second exterior arc connecting to the first exterior generally linear portion;

a third exterior arc having an angle of about 180 degrees curving opposite the second exterior arc and a third exterior radius less than the second exterior radius, the third exterior arc connecting to the second exterior arc;

a fourth exterior arc curving inward and connecting to an end of the first exterior arc.

8. The apparatus of claim 1 wherein the elongated body has a outside contour forming a "comma" shape.

9. The apparatus of claim 1 further comprising a removable cap on the top of the body.

10. The apparatus of claim 9 wherein the cap hingedly connects to the body.

11. The apparatus of claim 1 further comprising a removable cover over the aperture.

12. The apparatus of claim 11 wherein the cover hingedly connects to the top.

13. The apparatus of claim 6 wherein the elongated body has an inside contour formed by:

an interior arc of the inner wall having an angle of less than about 360 degrees;

an interior section of the inner wall connecting to the interior arc;

the baffle running generally parallel along the interior section and forming a channel therebetween.

14. The apparatus of claim 13 wherein the plastic body is substantially transparent.

15. A method for singularly dispensing an item from a plurality of elongated items comprising: providing an apparatus having an elongated body having a top, an inner wall having a flat side with a length approximately equal to a length of an elongated item of the plurality of elongated items, an interior arc of the inner wall having an angle of less than about 360 degrees, and an interior volume, a baffle disposed on the inner wall within the interior volume and oriented relative to the inner wall, the baffle forming a channel to receive at least one elongated item, the channel having a width less than twice a thickness of the elongated item, an aperture in the top above the channel and adapted to permit passage of a single elongated item, and a plurality of elongated items within the interior volume; rotating the apparatus to urge the plurality of elongated items toward the baffle; urging at least one elongated item around the baffle, along the flat side of the inner wall and into the channel, the at least one elongated item aligned within the channel and separated from the remaining plurality of elongated items; and reciprocating the apparatus to pass one elongated item through the aperture.

16. The method of claim 15 further comprising opening a cover on the aperture before reciprocating to singularly pass at least one elongated item and closing the cover after reciprocating.

17. The method of claim 15 further comprising aligning a column of laterally oriented elongated items in the channel.

18. The method of claim 15 wherein the elongated item comprises a dental applicator.

19. The method of claim 17 wherein the baffle supports a weight of the remaining plurality of elongated items to allow unimpeded movement of the laterally oriented elongated items in the channel.

* * * * *